US009964896B2

(12) United States Patent
Sasaki

(10) Patent No.: US 9,964,896 B2
(45) Date of Patent: May 8, 2018

(54) DEVELOPMENT DEVICE AND IMAGE FORMING APPARATUS INCLUDING SAME

(71) Applicant: KYOCERA Document Solutions Inc., Osaka (JP)

(72) Inventor: Yu Sasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/634,506

(22) Filed: Jun. 27, 2017

(65) Prior Publication Data

US 2018/0011425 A1 Jan. 11, 2018

(30) Foreign Application Priority Data

Jul. 5, 2016 (JP) ..... 2016-133237

(51) Int. Cl.
*G03G 15/08* (2006.01)

(52) U.S. Cl.
CPC ..... *G03G 15/0889* (2013.01); *G03G 15/0891* (2013.01); *G03G 2215/083* (2013.01); *G03G 2215/0833* (2013.01)

(58) Field of Classification Search
CPC ..... G03G 15/0889; G03G 15/0891; G03G 15/0893; G03G 2215/0827; G03G 2215/083; G03G 2215/0833
See application file for complete search history.

(56) References Cited

U.S. PATENT DOCUMENTS

| | | | | |
|---|---|---|---|---|
| 9,316,948 | B2 * | 4/2016 | Tsukijima | G03G 15/0893 |
| 9,429,875 | B1 * | 8/2016 | Suenami | G03G 15/0844 |
| 9,841,703 | B2 * | 12/2017 | Ishida | G03G 15/0844 |
| 2008/0260430 | A1 * | 10/2008 | Sakamoto | G03G 15/0822 399/254 |
| 2011/0150537 | A1 * | 6/2011 | Watanabe | G03G 15/0839 399/256 |
| 2012/0177412 | A1 * | 7/2012 | Watanabe | G03G 15/0189 399/256 |
| 2012/0201573 | A1 * | 8/2012 | Watanabe | G03G 15/0853 399/256 |

(Continued)

FOREIGN PATENT DOCUMENTS

JP 2015-11158 A 1/2015

*Primary Examiner* — Carla Therrien
(74) *Attorney, Agent, or Firm* — Stein IP, LLC

(57) ABSTRACT

A development device includes a development container and a second agitation member. The development container includes a second transport chamber and a developer discharge port which is provided at the end portion of the second transport chamber on a downstream side. The second agitation member includes a second transport blade, a damming member which dams a developer, a regulation portion which transports the developer in a direction opposite to the second transport blade and a discharge blade which discharges the developer from the developer discharge portion. A second rotation shaft includes a large shaft diameter portion on which the second transport blade is provided, a small shaft diameter portion on which the regulation portion and the discharge blade are provided and a shaft diameter change portion. The damming member is arranged between the shaft diameter change portion and the end portion of the second transport blade on the downstream side.

10 Claims, 5 Drawing Sheets

(56) References Cited

U.S. PATENT DOCUMENTS

| | | | | |
|---|---|---|---|---|
| 2014/0161490 | A1* | 6/2014 | Yamane | G03G 15/0887 399/257 |
| 2015/0003876 | A1 | 1/2015 | Iida et al. | 399/254 |
| 2015/0030354 | A1* | 1/2015 | Ishida | G03G 15/0921 399/254 |
| 2015/0139696 | A1* | 5/2015 | Ishida | G03G 15/0893 399/254 |
| 2015/0139697 | A1* | 5/2015 | Tsukijima | G03G 15/0893 399/254 |
| 2015/0277294 | A1* | 10/2015 | Kurihara | G03G 15/0891 399/254 |
| 2016/0259269 | A1* | 9/2016 | Tanaka | G03G 15/0893 |
| 2016/0370732 | A1* | 12/2016 | Sasaki | G03G 15/0844 |
| 2016/0370734 | A1* | 12/2016 | Suenami | G03G 15/0889 |
| 2017/0052482 | A1* | 2/2017 | Ishida | G03G 15/0891 |
| 2017/0219958 | A1* | 8/2017 | Sasaki | G03G 15/0893 |
| 2017/0248868 | A1* | 8/2017 | Iwata | G03G 15/0812 |

* cited by examiner

DEVELOPMENT DEVICE AND IMAGE FORMING APPARATUS INCLUDING SAME

INCORPORATION BY REFERENCE

This application is based upon and claims the benefit of priority from the corresponding Japanese Patent Application No. 2016-133237 filed on Jul. 5, 2016, the entire contents of which are incorporated herein by reference.

BACKGROUND

The present disclosure relates to a development device that is used in an image forming apparatus, such as a copying machine, a printer, a facsimile machine or a multifunctional machine thereof, which utilizes an electrophotographic method and an image forming apparatus that includes such a development device. More particularly, the present invention relates to a development device that supplies a two-component developer composed of a toner and a carrier and that discharges the excess developer and an image forming apparatus that includes such a development device.

In an image forming apparatus, a latent image that is formed on an image carrying member composed of a photosensitive member and the like is developed with a development device so as to be visualized as a toner image. In one of such development devices, a two-component development method using a two-component developer is adopted. In this type of development device, the two-component developer (hereinafter also simply referred to as a developer) composed of a carrier and a toner is stored within a development container, a development roller that supplies the developer to an image carrying member is provided and an agitation member is also provided that supplies the developer within the development container to the development roller while transporting and agitating the developer.

Although in this development device, the toner is consumed by the development operation, the carrier is left within the development device without being consumed. Hence, the carrier which is agitated together with the toner within the development container is degraded as the frequency of agitation is increased, with the result that the charging performance of the carrier for the toner is gradually lowered.

Hence, a development device is known in which a developer containing a carrier is supplied into a development container and in which the excess developer is discharged such that a decrease in charging performance is reduced.

For example, a development device is known in which in a system for supplying a carrier and a toner into a development container, an agitation member includes: a first transport portion that transports a developer within the development container; a second transport portion that is provided on the downstream side of the first transport portion in a transport direction and that is formed with a spiral blade which transports the developer in a direction opposite to the first transport portion and which is faced oppositely; a disk portion (damming member) that is provided on the upstream side of the second transport portion in the transport direction; and a third transport portion that is provided on the upstream side of the disk portion in the transport direction of the second transport portion, that transports the developer in the same direction as the first transport portion and that discharges the developer from a developer discharge port.

In the development device including the first transport portion, the second transport portion and the third transport portion, when the developer is supplied into the development container, by the rotation of the first transport portion, the developer is transported to the downstream side of a transport chamber while being agitated. When the opposite spiral blade of the second transport portion is rotated in the same direction as the first transport portion, a transport force in a direction opposite to the transport direction of the first transport portion is applied to the developer. By the transport force in the opposite direction, the developer is dammed to become bulky, and thus the excess developer is passed over the second transport portion and the disk portion (damming member), is moved to the developer discharge port and is discharged to the outside.

Conventionally, a development device is known which includes, as an agitation member for agitating and transporting a developer, a first transport portion that transports the developer and a disk portion (damming member) that is provided on the downstream side of the first transport portion in a transport direction and that dams the developer transported by the first transport portion. In such an agitation member, a rotation shaft may be used which includes a large shaft diameter portion that is provided in the first transport portion, a small shaft diameter portion that is smaller in diameter than the large shaft diameter portion and a shaft diameter change portion that is arranged in a boundary between the large shaft diameter portion and the small shaft diameter portion.

SUMMARY

A development device according to one aspect of the present disclosure includes a development container, a first agitation member, a second agitation member and a developer carrying member. The development container includes: a plurality of transport chambers which include a first transport chamber and a second transport chamber that are arranged so as to be aligned with each other; communication portions which make the first transport chamber and the second transport chamber communicate with each other on the sides of both end portions in the longitudinal direction of the first transport chamber and the second transport chamber; a developer supply port through which a developer is supplied; and a developer discharge port which is provided at an end portion of the second transport chamber on a downstream side and through which the excess developer is discharged, and a two-component developer containing a carrier and a toner is stored. The first agitation member is formed with a first rotation shaft and a first transport blade formed on an outer circumferential surface of the first rotation shaft and agitates and transports the developer within the first transport chamber in the axial direction of the first rotation shaft. The second agitation member is formed with a second rotation shaft and a second transport blade formed on an outer circumferential surface of the second rotation shaft and agitates and transports the developer within the second transport chamber in a direction opposite to the first agitation member. The developer carrying member is rotatably supported by the development container and carries the developer within the second transport chamber on a surface. The second agitation member includes a regulation portion, a discharge blade and a damming member. The regulation portion is formed on the downstream side of the second transport blade in a direction in which the developer within the second transport chamber is transported and is formed with a transport blade that transports the developer within the second transport chamber in a direction opposite to the second agitation member. The discharge blade is formed on the downstream side of the regulation portion in the direction in which the developer within the second transport chamber is transported and transports the developer in the same direction as the second transport blade so as to discharge the developer from the developer discharge port. The damming member is formed on an upstream side of the regulation portion in the direction in which the developer within the second transport chamber is transported and dams the developer transported by the second transport blade. The second rotation shaft includes: a large shaft diameter portion on which the second transport blade is provided; a small shaft diameter portion on which the regulation portion and the discharge blade are provided and which has a smaller diameter than the large shaft diameter portion; and a shaft diameter change portion which is arranged in a boundary between the large shaft diameter portion and the small shaft diameter portion. The damming member is arranged between the shaft diameter change portion and the end portion of the second transport blade on the downstream side.

Further other objects of the present disclosure and specific advantages obtained by the present disclosure will become more apparent from the description of an embodiment given below.

DETAILED DESCRIPTION

Figure 1:
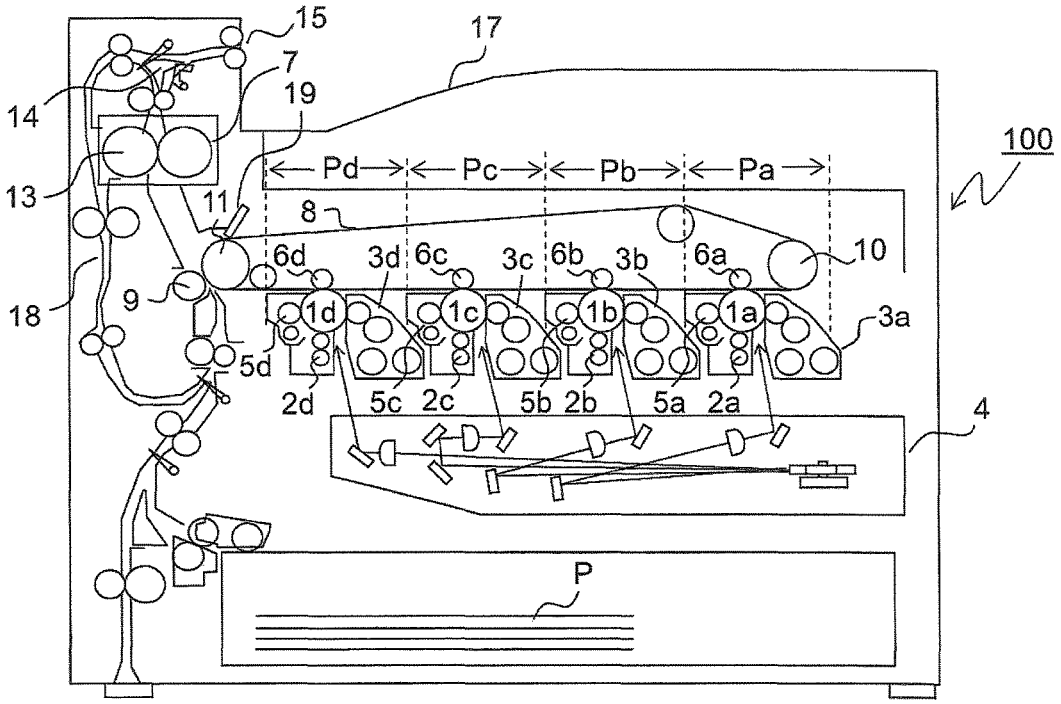
FIG. 1 is a schematic cross-sectional view of an image forming apparatus 100 in which the development devices 3*a* to 3*d* of the present disclosure are incorporated.

An embodiment of the present disclosure will be described below with reference to drawings. FIG. 1 is a schematic cross-sectional view of an image forming apparatus 100 in which the development devices 3*a* to 3*d* of the present disclosure are incorporated, and here, FIG. 1 shows a tandem-type color printer. Within the main body of the image forming apparatus 100, four image formation portions Pa, Pb, Pc and Pd are arranged sequentially from the upstream side in a transport direction (in FIG. 1, the right side). The image formation portions Pa to Pd are provided so as to correspond to the images of four different colors (cyan, magenta, yellow and black), and respectively and sequentially form the images of cyan, magenta, yellow and black in the steps of charging, exposure, development and transfer.

In the image formation portions Pa to Pd, photosensitive drums 1*a*, 1*b*, 1*c* and 1*d* which carry the visible images (toner images) of the individual colors are provided, and an intermediate transfer belt 8 which is rotated by a drive means (not shown) in a clockwise direction in FIG. 1 is further provided adjacent to the image formation portions Pa to Pd. The toner images formed on the photosensitive drums 1*a* to 1*d* are sequentially transferred on the intermediate transfer belt 8 which is moved while making contact with the photosensitive drums 1*a* to 1*d*, are then transferred in a secondary transfer roller 9 on a transfer sheet P at a time, are further fixed with a fixing portion 7 on the transfer sheet P and are then discharged from the main body of the apparatus. While the photosensitive drums 1*a* to 1*d* are being rotated in a counterclockwise direction in FIG. 1, an image formation process is performed on the photosensitive drums 1*a* to 1*d*.

The transfer sheet P to which the toner images are transferred is stored within a sheet cassette in a lower portion of the main body of the image forming apparatus 100, and is transported to the secondary transfer roller 9 through a paper feed roller and a registration roller pair. On the downstream side of the secondary transfer roller 9, a blade-shaped belt cleaner 19 for removing the toners left on the surface of the intermediate transfer belt 8 is arranged.

The image formation portions Pa to Pd will then be described. Around and below the photosensitive drums 1*a* to 1*d* which are rotatably provided, chargers 2*a*, 2*b*, 2*c* and 2*d* which charge the photosensitive drums 1*a* to 1*d*, an exposure unit 4 which exposes image information to the photosensitive drums 1*a* to 1*d*, the development devices 3*a*, 3*b*, 3*c* and 3*d* which form the toner images on the photosensitive drums 1*a* to 1*d* and cleaning portions 5*a*, 5*b*, 5*c* and 5*d* which remove the developers (toners) left on the photosensitive drums 1*a* to 1*d* are provided.

When an image formation start is input from a higher device such as a personal computer, the surfaces of the photosensitive drums 1*a* to 1*d* are first and uniformly charged by the chargers 2*a* to 2*d*, then light is applied by the exposure unit 4 and thus electrostatic latent images corresponding to image signals are formed on the photosensitive drums 1*a* to 1*d*. In the development devices 3*a* to 3*d*, predetermined amounts of toners of the individual colors of cyan, magenta, yellow and black are respectively loaded with a supply device (not shown). The toners are supplied with the development devices 3*a* to 3*d* on the photosensitive drums 1*a* to 1*d* and are electrostatically adhered, and thus the toner images corresponding to the electrostatic latent images formed by the exposure with the exposure unit 4 are formed.

Then, an electric field is applied to the intermediate transfer belt 8 with a predetermined transfer voltage, and then the toner images of cyan, magenta, yellow and black on the photosensitive drums 1*a* to 1*d* are transferred on the intermediate transfer belt 8 with first transfer rollers 6*a* to 6*d*. Thereafter, in order to prepare for the subsequent formation of new electrostatic latent images, the toners left on the surfaces of the photosensitive drums 1*a* to 1*d* are removed with the cleaning portions 5*a* to 5*d*.

The intermediate transfer belt 8 is placed over a plurality of stretching rollers including a transport roller 10 on the upstream side and a drive roller 11 on the downstream side, and when the rotation of the intermediate transfer belt 8 in the clockwise direction is started by the rotation of the drive roller 11 with a drive motor (not shown), the transfer sheet P is transported, with predetermined timing, to the secondary transfer roller 9 provided adjacent to the intermediate transfer belt 8, with the result that a full-color image is transferred. The transfer sheet P to which the toner images are transferred is transported to the fixing portion 7.

The transfer sheet P transported to the fixing portion 7 is heated and pressurized with a fixing roller pair 13, and thus the toner images are fixed to the surface of the transfer sheet P, with the result that the predetermined full-color image is formed. The transport direction of the transfer sheet P on which the full-color image is formed is divided by a branch portion 14 which is branched in a plurality of directions. When an image is formed on only one side of the transfer sheet P, the transfer sheet P, as it is (or after being fed to a reverse transport path 18 where double-sided printing is performed), is ejected by an ejection roller pair 15 to an ejection tray 17.

Figure 2:
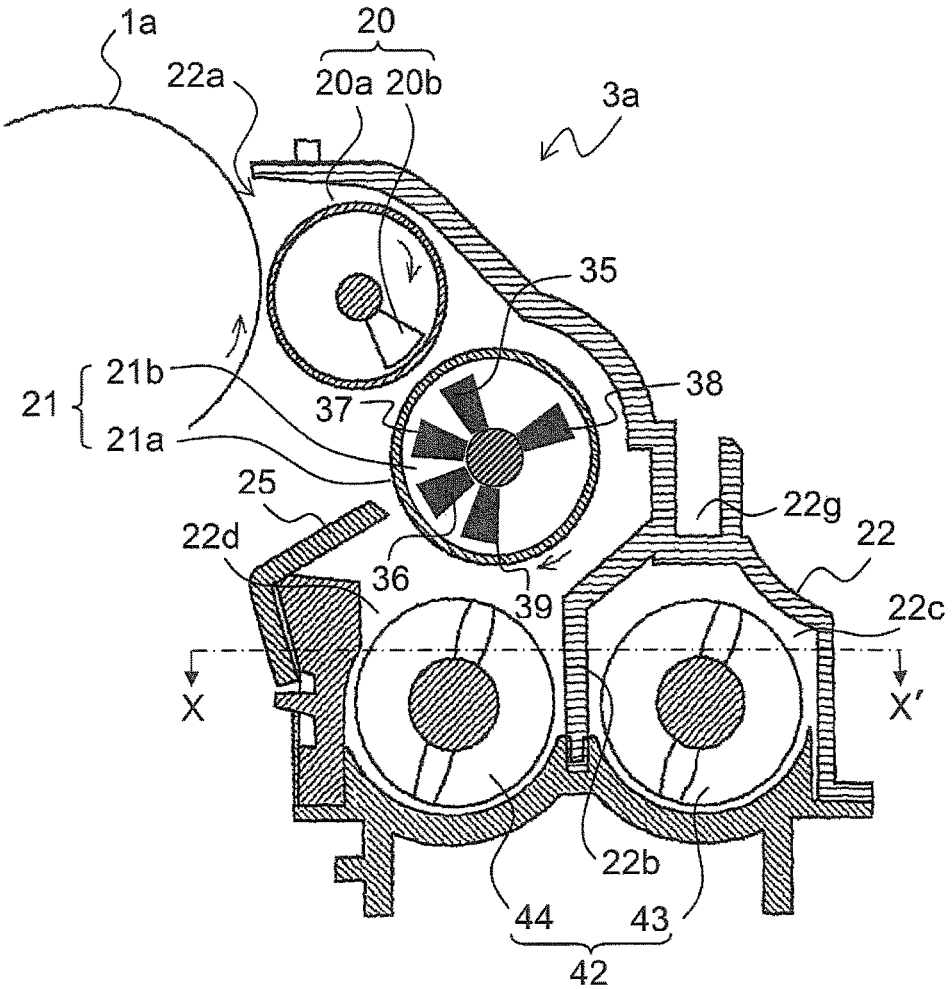
FIG. 2 is a side cross-sectional view of the development device 3*a* according to an embodiment of the present disclosure.

FIG. 2 is a side cross-sectional view showing the configuration of the development device 3*a* which is incorporated in the image forming apparatus 100. Although here, the development device 3*a* arranged in the image formation portion Pa of FIG. 1 will be described, the configurations of the development devices 3*b* to 3*d* arranged in the image formation portions Pb to Pd are basically the same, and thus the description thereof will be omitted.

As shown in FIG. 2, the development device 3*a* includes a development container 22 in which a two-component developer is stored. In the development container 22, an opening 22*a* through which a development roller 20 is exposed toward the photosensitive drum is formed, and the development container 22 is partitioned by a partition wall 22*b* into first and second transport chambers 22*c* and 22*d*. In the first and second transport chambers 22*c* and 22*d*, an agitation member 42 is rotatably provided which is formed with a first agitation screw (first agitation member) 43 and a second agitation screw (second agitation member) 44 for mixing, agitating and charging the toner (positively charged toner) supplied from an unillustrated toner container and a carrier.

The developer is transported with the first agitation screw 43 and the second agitation screw 44 in an axial direction while being agitated therewith and is circulated between the first and second transport chambers 22*c* and 22*d* through communication portions 22*e* and 22*f* (see FIG. 3) which are formed at both ends of the partition wall 22*b*. In the example of the figure, the development container 22 is extended obliquely upward to the left, and within the development container 22, a magnetic roller (developer carrying member) 21 is arranged above the second agitation screw 44, and the development roller 20 is arranged opposite the magnetic roller 21 obliquely upward to the left with respect to the magnetic roller 21. Then, on the side of the opening 22*a* (the left side of FIG. 2) in the development container 22, the development roller 20 is opposite the photosensitive drum 1*a*, and the magnetic roller 21 and the development roller 20 are rotated in the clockwise direction in FIG. 2.

In the development container 22, a toner concentration sensor (not shown) is arranged so as to face the first agitation screw 43, and the toner is supplied into the development container 22 according to a toner concentration detected by the toner concentration sensor from the supply device (not shown) through a developer supply port 22*g*.

The magnetic roller 21 is formed with a nonmagnetic rotation sleeve 21*a* and a fixed magnet member 21*b* which is enclosed by the rotation sleeve 21*a* and which has a plurality of magnetic poles. In the present embodiment, the magnetic poles of the fixed magnet member 21*b* are formed with the five poles of a main pole 35, a regulation pole (magnetic pole for ear cutting) 36, a transport pole 37, a separation pole 38 and a pumping pole 39. The magnetic roller 21 and the development roller 20 are opposite each other in the facing position (opposite position) thereof with a predetermined gap.

An ear cutting blade 25 is attached to the development container 22 along the longitudinal direction (direction perpendicular to the plane of FIG. 2) of the magnetic roller 21, and the ear cutting blade 25 is located on the upstream side in the rotation direction (clockwise direction in FIG. 2) of the magnetic roller 21 with respect to the opposite position of the development roller 20 and the magnetic roller 21. A slight space (gap) is formed between the tip end portion of the ear cutting blade 25 and the surface of the magnetic roller 21.

The development roller 20 is formed with a nonmagnetic development sleeve 20*a* and a development roller side magnetic pole 20*b* which is fixed within the development sleeve 20*a*. The development roller side magnetic pole 20*b* has a polarity different from the magnetic pole (main pole) 35 opposite the fixed magnet member 21*b*.

As described previously, with the first agitation screw 43 and the second agitation screw 44, the developer is circulated within the development container 22 while being agitated, the toner is charged and the developer is transported with the second agitation screw 44 to the magnetic roller 21. Since the regulation pole 36 of the fixed magnet member 21*b* is opposite the ear cutting blade 25, as the ear cutting blade 25, a nonmagnetic material or a magnetic material of a polarity different from the regulation pole 36 is used, and thus a magnetic field in an attracting direction is generated in the gap between the tip end of the ear cutting blade 25 and the rotation sleeve 21*a*.

By the magnetic field, a magnetic brush is formed between the ear cutting blade 25 and the rotation sleeve 21*a*. Then, when the magnetic brush on the magnetic roller 21 is moved to the position opposite the development roller 20 after being regulated in the thickness of its layer by the ear cutting blade 25, since the attracting magnetic field is applied by the main pole 35 of the fixed magnet member 21*b* and the development roller side magnetic pole 20*b*, the magnetic brush makes contact with the surface of the development roller 20. Then, a toner thin layer is formed on the development roller 20 by a potential difference between a direct-current bias applied to the magnetic roller 21 and a direct-current bias applied to the development roller 20 and the magnetic field.

The toner thin film formed on the development roller 20 with the magnetic brush is transported by the rotation of the development roller 20 to the opposite portion of the photosensitive drum la and the development roller 20, the toner is scattered by a potential difference between the development roller 20 and the photosensitive drum 1*a* and thus the electrostatic latent image on the photosensitive drum 1*a* is developed.

Furthermore, when the development sleeve 20*a* is rotated in the clockwise direction, at this time, the magnetic brush is separated from the surface of the development roller 20 by a magnetic field in a horizontal direction (circumferential direction of the roller) generated by the separation pole 38 which is adjacent to the main pole 35 and which has a different polarity, and the toner left without being used for the development is collected on the rotation sleeve 21*a* from the development roller 20. Furthermore, when the rotation sleeve 21*a* is rotated, a repelling magnetic field is applied by the separation pole 38 of the fixed magnet member 21*b* and the pumping pole 39 having the same polarity as the separation pole 38, and thus the toner is separated from the rotation sleeve 21*a* within the development container 22.

Then, after the toner is agitated and transported with the second agitation screw 44, as the two-component developer which has an appropriate toner concentration and which is uniformly charged, the magnetic brush is formed again by the pumping pole 39 on the on the rotation sleeve 21*a* and is transported to the ear cutting blade 25.

Figure 3:
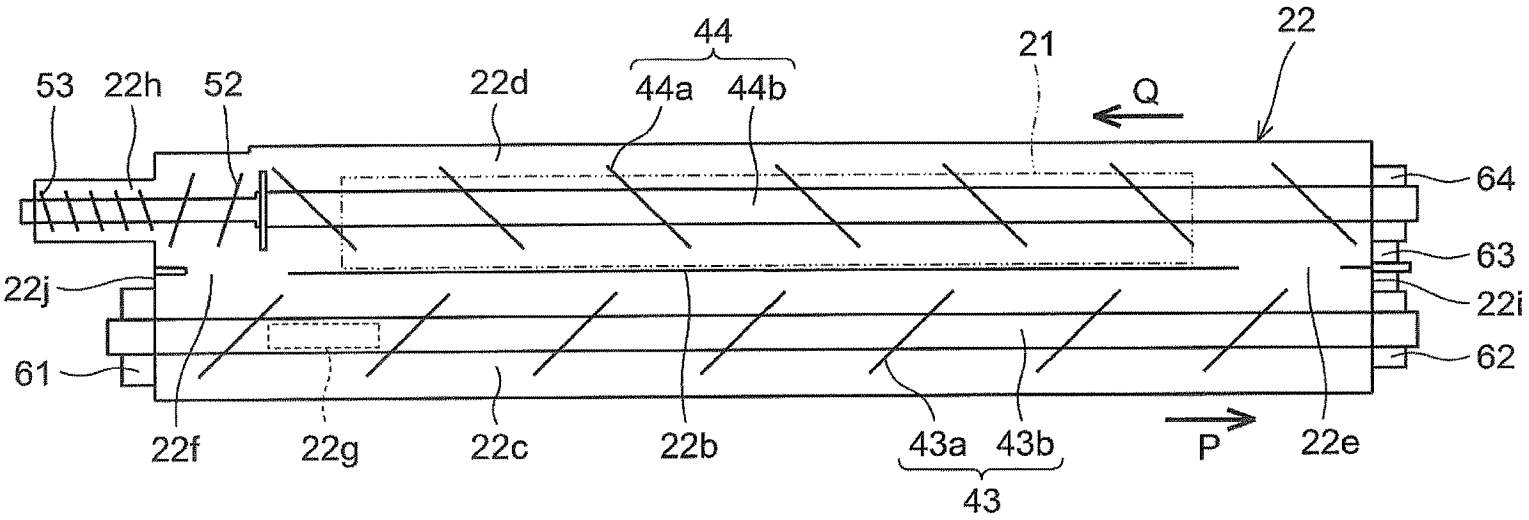
FIG. 3 is a plan cross-sectional view showing the agitation portion of the development device 3*a* in the present embodiment.

The configuration of the agitation member in development device 3*a* will then be described in detail. FIG. 3 is a plan cross-sectional view (cross-sectional view taken along line XX' with arrows in FIG. 2) showing the agitation member in the development device 3*a*.

In the development container 22, as described previously, the first transport chamber 22*c*, the second transport chamber 22*d*, the partition wall 22*b*, the upstream side communication portion 22*e*, the downstream side communication portion 22*f* and the developer supply port 22*g* are formed, and a developer discharge port 22*h*, an upstream side wall portion 22*i* and a downstream side wall portion 22*j* are further formed. It is assumed that in the first transport chamber 22*c*, the left side of FIG. 3 is the upstream side and the right side of FIG. 3 is the downstream side, and that in the second transport chamber 22*d*, the right side of FIG. 3 is the upstream side and the left side of FIG. 3 is the downstream side. Hence, the communication portions and the side wall portions are referred to as the upstream portions and the downstream portions with respect to the second transport chamber 22*d*.

The partition wall 22*b* is extended in the longitudinal direction of the development container 22 and thereby partitions the first transport chamber 22*c* and the second transport chamber 22*d* such that they are aligned. The end portion on the right side in the longitudinal direction of the partition wall 22*b* forms the upstream side communication portion 22*e* together with the inner wall portion of the upstream side wall portion 22*i* whereas the end portion on the left side in the longitudinal direction of the partition wall 22*b* forms the downstream side communication portion 22*f* together with the inner wall portion of the downstream side wall portion 22*j*. The developer can be circulated within the first transport chamber 22*c*, the upstream side communication portion 22*e*, the second transport chamber 22*d* and the downstream side communication portion 22*f*.

The developer supply port 22*g* is an opening for supplying the new toner and carrier from a developer supply container (unillustrated) provided above the development container 22 into the development container 22, and is arranged on the upstream side (the left side of FIG. 3) of the first transport chamber 22*c*.

The developer discharge port 22*h* is an opening for discharging the excess developer resulting from the supply of the developer within the first and second transport chambers 22*c* and 22*d*, and is continuously provided on the downstream side of the second transport chamber 22*d* in the longitudinal direction of the second transport chamber 22*d*.

The first agitation screw 43 is arranged within the first transport chamber 22*c*, and the second agitation screw 44 is arranged within the second transport chamber 22*d*.

The first agitation screw 43 includes a first rotation shaft 43*b* and a first spiral blade (first transport blade) 43*a* which is provided integrally with the first rotation shaft 43*b* and which is formed in a spiral shape with a constant pitch in the axial direction of the first rotation shaft 43*b*. The first spiral blade 43*a* is extended to the sides of both end portions in the longitudinal direction of the first transport chamber 22*c*, and is provided opposite the upstream side and downstream side communication portions 22*e* and 22*f*. The first rotation shaft 43*b* is rotatably supported by the upstream side wall portion 22*i* and the downstream side wall portion 22*j* of the development container 22.

The second agitation screw 44 includes a second rotation shaft 44*b* and a second spiral blade (second transport blade) 44*a* which is provided integrally with the second rotation shaft 44*b*, which is formed with the same pitch as the first spiral blade 43*a* in the axial direction of the second rotation shaft 44*b* and which is formed in a spiral shape as a blade (in the opposite phase) that is directed in a direction opposite to the first spiral blade 43*a*. The second spiral blade 44*a* has a length which is equal to or more than the length of the magnetic roller 21 in the axial direction, and is further provided so as to be extended to the position opposite the upstream side communication portion 22*e*. The second rotation shaft 44*b* is arranged parallel to the first rotation shaft 43*b*, and is rotatably supported by the upstream side wall portion 22*i* and the downstream side wall portion 22*j* of the development container 22.

Together with the second spiral blade 44*a*, a regulation portion 52 and a discharge blade 53 are provided integrally with the second rotation shaft 44*b*.

The regulation portion 52 is arranged within the second transport chamber 22*d*, and makes it possible to block the developer transported to the downstream side within the second transport chamber 22*d* and to transport a predetermined amount or more of developer to the developer discharge port 22*h*. The regulation portion 52 is formed with a spiral blade which is provided on the second rotation shaft 44*b* and is formed in a spiral shape as a blade (in the opposite phase) that is directed in a direction opposite to the second spiral blade 44*a*. The regulation portion 52 has an outside diameter which is smaller than that of the second spiral blade 44*a* but larger than that of the discharge blade 53, and the pitch thereof is set smaller than that of the second spiral blade 44*a*. The regulation portion 52 is formed such that a predetermined gap is formed between the inner circumferential surface of the development container 22 such as the downstream side wall portion 22*j* and the outer circumferential portion of the regulation portion 52. The excess developer is transported through the gap to the developer discharge port 22*h*.

The second rotation shaft 44*b* is extended into the developer discharge port 22*h*. The discharge blade 53 is provided on the second rotation shaft 44*b* within the developer discharge port 22*h*. Although the discharge blade 53 is formed with a blade in a spiral shape which is directed in the same direction as the second spiral blade 44*a*, the pitch thereof is smaller than that of the second spiral blade 44*a* and the outside diameter of the blade is smaller than that of the second spiral blade 44*a*. Hence, when the second rotation shaft 44*b* is rotated, the discharge blade 53 is also rotated, and the excess developer which is passed over the regulation portion 52 into the developer discharge port 22*h* is fed to the left side of FIG. 3 and is discharged to the outside of the development container 22. The discharge blade 53, the regulation portion 52 and the second spiral blade 44*a* are molded of a synthetic resin integrally with the second rotation shaft 44*b*.

Gears 61 to 64 are arranged on the outer wall of the development container 22. The gears 61 and 62 are fixed to the first rotation shaft 43*b*, the gear 64 is fixed to the second rotation shaft 44*b* and the gear 63 is rotatably held by the development container 22 and is engaged with the gears 62 and 64.

When the developer is not newly supplied at the time of development, and the gear 61 is rotated by a drive source such as a motor, the first spiral blade 43*a* is rotated together with the first rotation shaft 43*b* and thus the developer within the first transport chamber 22*c* is transported by the first spiral blade 43*a* in the direction of an arrow P, is thereafter passed through the upstream side communication portion 22*e* and is transported into the second transport chamber 22*d*. Furthermore, when the second spiral blade 44*a* is rotated together with the second rotation shaft 44*b* which is moved together with the second rotation shaft 44*b*, the developer within the second transport chamber 22*d* is transported by the second spiral blade 44*a* in the direction of an arrow Q. Hence, the developer is passed from the first transport chamber 22*c* through the upstream side communication portion 22*e* into the second transport chamber 22*d*, and is passed through the downstream side communication portion 22*f* into the first transport chamber 22*c* without being passed over the regulation portion 52.

As described above, the developer is agitated while being circulated from the first transport chamber 22*c* to the upstream side communication portion 22*e* to the second transport chamber 22*d* and then to the downstream side communication portion 22*f*, the agitated developer is supplied to the magnetic roller 21.

A case where the developer is supplied from the developer supply port 22*g* will then be described. When the toner is consumed by the development, the developer containing the carrier is supplied from the developer supply port 22*g* into the first transport chamber 22*c*.

As at the time of development, the supplied developer is transported by the first spiral blade 43*a* in the direction of the arrow P within the first transport chamber 22*c* and is thereafter passed through the upstream side communication portion 22*e* into the second transport chamber 22*d*. Furthermore, the developer within the second transport chamber 22*d* is transported by the second spiral blade 44*a* in the direction of the arrow Q. When the regulation portion 52 is rotated by the rotation of the second rotation shaft 44*b*, a transport force in an opposite direction (the direction of the arrow P) is applied by the regulation portion 52 to the developer. By the regulation portion 52, the developer is dammed to become bulky, and thus the excess developer is passed over the regulation portion 52 and is discharged through the developer discharge port 22*h* to the outside of the development container 22.

A structure around the developer discharge port 22*h* will then be described.

Figure 4:
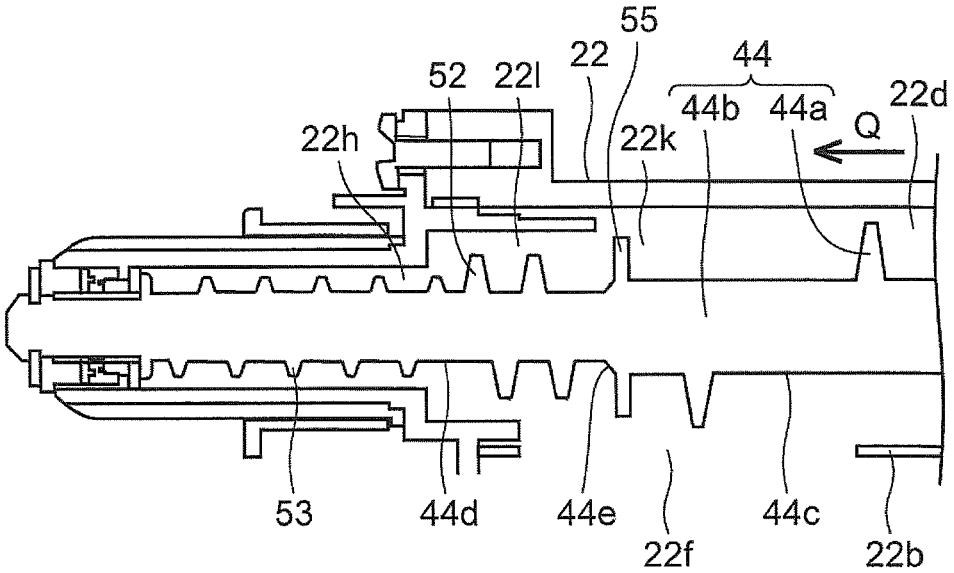
FIG. 4 is an enlarged view around a developer discharge portion 22*h* in FIG. 3.

As shown in FIG. 4, the second rotation shaft 44*b* includes a large shaft diameter portion 44*c*, a small shaft diameter portion 44*d* that has a smaller diameter than the large shaft diameter portion 44*c* and a shaft diameter change portion 44*e* that is arranged in a boundary between the large shaft diameter portion 44*c* and the small shaft diameter portion 44*d*. On the large shaft diameter portion 44*c*, the second spiral blade 44*a* is provided, and on the small shaft diameter portion 44*d*, the regulation portion 52 and the discharge blade 53 are provided. In other words, the shaft diameter change portion 44*e* is provided between the second spiral blade 44*a* and the regulation portion 52.

The diameter of the small shaft diameter portion 44*d* is equal to or more than three fourths of the diameter of the large shaft diameter portion 44*c*. Specifically, when the diameter of the large shaft diameter portion 44*c* is, for example, 8 mm, the diameter of the small shaft diameter portion 44*d* is equal to or more than 6 mm. The shaft diameter change portion 44*e* is arranged in a position opposite the downstream side communication portion 22*f* and is formed in such a tapered shape that the diameter of the shaft is gradually changed along the axial direction of the second rotation shaft 44*b*.

The second transport chamber 22*d* includes: a large inside diameter portion 22*k* in which the second spiral blade 44*a* is arranged and which has a first inside diameter; and a small inside diameter portion 221 in which the regulation portion 52 is arranged and which has a second inside diameter that is smaller than the first inside diameter but larger than the inside diameter of the developer discharge port 22*h*.

A gap between the outer circumferential portion of the regulation portion 52 and the inner circumferential surface of the small inside diameter portion 221 is larger than a gap between the outer circumferential portion of the second spiral blade 44*a* and the inner circumferential surface of the large inside diameter portion 22*k* and a gap between the outer circumferential portion of the discharge blade 53 and the inner circumferential surface of the developer discharge port 22*h*. In the present embodiment, the gap between the outer circumferential portion of the second spiral blade 44*a* and the inner circumferential surface of the large inside diameter portion 22*k* is formed to be equal to the gap between the outer circumferential portion of the discharge blade 53 and the inner circumferential surface of the developer discharge port 22*h*.

On the second agitation screw 44, a disk (damming member) 55 is arranged between the second spiral blade 44*a* and the regulation portion 52. The disk 55 is molded of a synthetic resin together with the second spiral blade 44*a*, the regulation portion 52 and the discharge blade 53 integrally with the second rotation shaft 44*b*.

The disk 55 is protruded in a radial direction over the entire circumference of the second rotation shaft 44*b* so as to dam the developer transported by the second spiral blade 44*a*. The disk 55 is arranged between the shaft diameter change portion 44*e* and the downstream side end portion of the second spiral blade 44*a* (the large shaft diameter portion 44*c*), and here, the disk 55 is formed continuously with the end portion of the shaft diameter change portion 44*e* on the side of the second spiral blade 44*a*.

The disk 55 has an outside diameter which is equal to or less than that of the second spiral blade 44*a* but equal to or more than that of the regulation portion 52. The disk 55 is arranged within the large inside diameter portion 22*k* and is arranged in a position opposite the downstream side communication portion 22*f*.

In the configuration of the present disclosure, the transport force of the developer transported by the second spiral blade 44*a* in the direction of the arrow Q is dammed by the disk 55 so as to be temporarily reduced. Then, the transport force in the opposite direction is applied by the regulation portion 52 to the developer so as to push back the developer in the direction of the arrow P. In other words, the disk 55 functions as a buffer which reduces the transport force (pressure) of the developer that is moved from the second transport chamber 22*d* toward the regulation portion 52. As the number of revolutions of the second agitation screw 44 is increased, the buffer effect (deceleration effect) produced by the disk 55 is more enhanced, and thus the speed and amount of developer which is passed through the regulation portion 52 are unlikely to depend on the number of revolutions of the second agitation screw 44 (developer transport speed).

Furthermore, the disk 55 is provided in the position opposite the downstream side communication portion 22*f* so as to serve to adjust the amount of developer which is moved to the side of the first agitation screw 43 and the amount of developer which is passed though the regulation portion 52, and they can be adjusted by the position in which the disk 55 is installed and the size (diameter or thickness) of the disk 55.

When the outside diameter of the disk 55 is smaller than that of the spiral blade of reverse winding which forms the regulation portion 52, the buffer effect (deceleration effect) of the disk 55 is insufficient, and thus the developer transported by the second spiral blade 44*a* is easily moved to the regulation portion 52. Hence, the outside diameter of the disk 55 is preferably equal to or more than that of the spiral blade of reverse winding which forms the regulation portion 52.

Then, when the developer is supplied from the developer supply port 22*g* such that the developer within the development container 22 becomes bulky, the pressure is reduced by the disk 55, and the developer around the regulation portion 52 is passed over the regulation portion 52 and is moved to the discharge blade 53 (the developer discharge port 22*h*), with the result that the excess developer is discharged from the developer discharge port 22*h*.

In the present embodiment, as described above, disk 55 is arranged between the shaft diameter change portion 44*e* and the end portion of the second spiral blade 44*a* on the downstream side. In this way, it is possible to reduce the formation of a recess around the disk 55, and thus it is possible to reduce the stay of the developer in the recess which causes the developer to be coagulated. Hence, it is possible to reduce the occurrence of an image failure caused by color points resulting from the adherence of the developer (and the toner) coagulated to the development roller 20 through the magnetic roller 21.

When the disk 55 is provided between the second spiral blade 44*a* and the regulation portion 52 which transports the developer in the direction opposite to the second spiral blade 44*a*, the pressure of the developer transported by the disk 55 is increased by the second spiral blade 44*a*, and thus the developer is easily coagulated around the disk 55, with the result that it is particularly effective to apply the present disclosure.

The regulation portion 52 is provided on the small shaft diameter portion 44*d*, and thus as compared with a case where the regulation portion 52 is provided on the large shaft diameter portion 44*c*, the design width of the outside diameter (the amount of protrusion of the second rotation shaft 44*b* from the outer circumferential surface) of the regulation portion 52 can be increased.

As described above, the shaft diameter change portion 44*e* is formed in such a tapered shape that the diameter of the shaft is gradually changed along the axial direction of the second rotation shaft 44*b*. In this way, it is possible to gradually change the diameter of the second rotation shaft 44*b*, and thus the developer transported by the regulation portion 52 in the opposite direction is prevented from staying in the step portion of the shaft diameter change portion 44*e*. Consequently, the developer can be smoothly diffused along the shaft diameter change portion 44*e* to the outside in the radial direction (the side of the outer circumferential portion of the disk 55).

As described above, the regulation portion 52 has a smaller outside diameter than the second spiral blade 44*a*. In this way, it is possible to reduce a problem in which the surface area of the regulation portion 52 is excessively increased and in which thus the transport force of the developer in the opposite direction is excessively increased.

As described above, the second transport chamber 22*d* includes: the large inside diameter portion 22*k* in which the second spiral blade 44*a* is arranged and which has the first inside diameter; and the small inside diameter portion 221 in which the regulation portion 52 is arranged and which has the second inside diameter that is smaller than the first inside diameter but larger than the inside diameter of the developer discharge port 22*h*. In this way, it is possible to reduce a problem in which the gap between the outer circumferential portion of the regulation portion 52 and the inner circumferential surface of the development container 22 is excessively increased, and thus the amount of developer which is moved to the developer discharge port 22*h* can be made appropriate.

The developer discharge port 22*h* has a smaller inside diameter than the second transport chamber 22*d*, and the shaft diameter change portion 44*e* is arranged between the second spiral blade 44*a* and the regulation portion 52. In this way, unlike a case where the shaft diameter change portion 44*e* is arranged between the regulation portion 52 and the discharge blade 53, the large shaft diameter portion 44*c* can be prevented from being arranged even around the developer discharge port 22*h*. Hence, it is possible to reduce the narrowing of the gap between the outer circumferential surface of the second rotation shaft 44*b* of the second agitation screw 44 and the opening portion of the developer discharge port 22*h* on the upstream side, and thus it is possible to more reduce the coagulation of the developer.

The disk 55 is arranged within the large inside diameter portion 22*k*. In this way, it is possible to reduce the narrowing of the gap between the outer circumferential portion of the disk 55 and the inner circumferential surface of the second transport chamber 22*d*, and thus it is possible to more reduce the coagulation of the developer.

As described above, the diameter of the small shaft diameter portion 44*d* is equal to or more than three fourths of the diameter of the large shaft diameter portion 44*c*. In this way, it is possible to reduce a problem in which the diameter of the small shaft diameter portion 44*d* is excessively decreased and in which thus the surface area of the regulation portion 52 is excessively increased, and thus it is possible to reduce an increase in the rotation torque of the second agitation screw 44.

The present disclosure is not limited to the embodiment described above, and various modifications are possible without departing from the spirit of the present disclosure. For example, the present disclosure is not limited to the development device which includes the magnetic roller 21 and the development roller 20 shown in FIG. 2, and can be applied to various types of development devices which use a two-component developer containing a toner and a carrier. For example, although in the embodiment discussed above, the development device of a two-shaft transport type which includes, as a developer circulation path within the development container 22, the first transport chamber 22*c* and the second transport chamber 22*d* that are arranged so as to be aligned with each other is described, the present disclosure can also be applied to the development device of a three-shaft transport type which includes a collection transport chamber that collects the developer pulled and separated from the magnetic roller 21 so as to join it into the second transport chamber 22*d*.

Although in the embodiment described above, the first transport screw 43 and the second transport screw 44 are used in which the first spiral blade 43*a* and the second spiral blade 44*a* are respectively and continuously provided on the outer circumferential surfaces of the first rotation shaft 43*b* and the second rotation shaft 44*b*, the transport blade which transports the developer is not limited to the spiral blade, and for example, an agitation transport member may be used in which a plurality of half-moon shaped plate members (members obtained by dividing a circular plate into two parts) are alternately arranged at predetermined inclination angles on the outer circumferential surfaces of the first rotation shaft 43*b* and the second rotation shaft 44*b*.

Although in the embodiment described above, the disk 55 is provided as the damming member, for example, as the damming member, a polygonal shaped member may be provided.

The present disclosure is not limited to the tandem-type color printer shown in FIG. 1 and can be applied to various types of image forming apparatuses, such as digital and analogue-type monochrome copying machines, a monochrome printer, a color copying machine and a facsimile machine, which use a two-component development method. The effects of the present disclosure will be more specifically described below using an example.

EXAMPLE

Variations in the number of sheets in which color points were produced due to the coagulation of the developer when the position of the arrangement of the disk 55 was changed in the image forming apparatus 100 as shown in FIG. 1 were studied. An experiment was performed on the image formation portion Pb of magenta including the photosensitive drum 1 b and the development device 3*b*.

Figure 5:
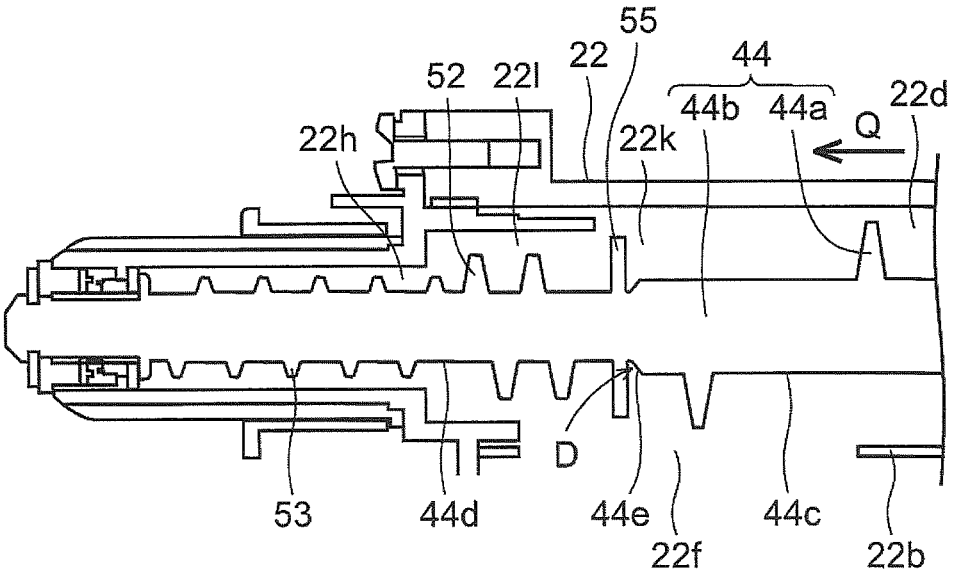
FIG. 5 is an enlarged view around the developer discharge portion 22*h* in the development device 3*b* in a comparative example.

As an experimental method, the development device 3*b* in which as shown in FIG. 4, the disk 55 was arranged between the shaft diameter change portion 44*e* and the end portion of the second spiral blade 44*a* on the downstream side (the large shaft diameter portion 44*c*) was used an example. The development device 3*b* in which as shown in FIG. 5, the disk 55 was arranged near the shaft diameter change portion 44*e* in the small shaft diameter portion 44*d* was used as a comparative example. In the comparative example, a recess D was formed between the disk 55 and the shaft diameter change portion 44*e*.

The second spiral blade 44*a* on the second agitation screw 44 used in the example and the comparative example was a spiral blade which had an outside diameter of 18 mm and a pitch of 30 mm, and the gap (clearance) between the outer circumferential portion of the second spiral blade 44*a* and the inner circumferential surface of the large inside diameter portion 22*k* was 1.0 mm. The regulation portion 52 was formed with two spiral blades of reverse winding (opposite phase) which had an outside diameter of 12 mm and a pitch of 5 mm, and the gap between the outer circumferential portion of the regulation portion 52 and the inner circumferential surface of the small inside diameter portion 221 was 1.5 mm. The discharge blade 53 was a spiral blade which had an outside diameter of 8 mm and a pitch of 5 mm, and the gap between the outer circumferential portion of the discharge blade 53 and the inner circumferential surface of the developer discharge port 22*h* was 1.0 mm. The diameter of the large shaft diameter portion 44*c* was 8 mm, and the diameter of the small shaft diameter portion 44*d* was 6 mm.

The disk 55 had an outside diameter of 17 mm, and the gap between the outer circumferential portion of the disk 55 and the inner circumferential surface of the large inside diameter portion 22*k* was 1.5 mm.

The development container 22 of the development device 3*b* in each of the example and the comparative example was filled with 270 g of the developer containing a positively charged toner and a ferrite carrier each of which had an average particle diameter of 6.7 μm, the rotation speeds of the first agitation screw 43 and the second agitation screw 44 were fixed to 300 rpm, 20000 sheets were continuously printed with a print coverage rate of 20%, thereafter 100 sheets were printed with a print coverage rate of 0% and the number of sheets in which color points were produced due to the coagulation of the developer was visually checked. In this experiment, in order for the coagulation of the developer to be easily performed, a low-melting point toner was used under the environment of high temperature and high humidity (32.5° C., 80%) was used and the toner concentration (T/C) was set to 8%. Then, the experiment was performed three times for each of the example and the comparative example. The results are shown in FIG. 6.

Figure 6:
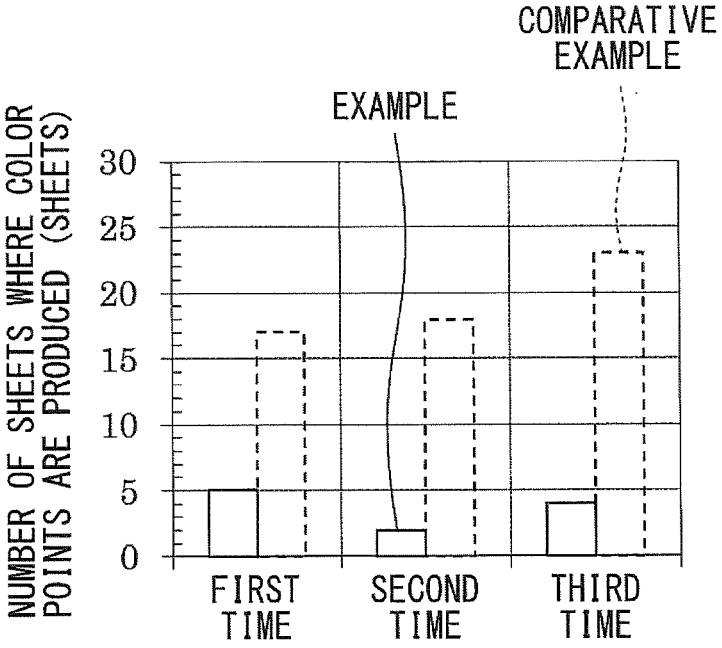
FIG. 6 is a graph showing the number of sheets in which color points were produced due to the coagulation of a developer in the development device 3*b* (example) where a disk 55 was arranged between a shaft diameter change portion 44*e* and the end portion of a second spiral blade 44*a* on a downstream side and in the development device 3*b* (the comparative example) where the disk 55 was arranged near the shaft diameter change portion 44*e* in a small shaft diameter portion 44*d*.

As is clear from FIG. 6, in the development device 3*b* of the example, as compared with the development device 3*b* of the comparative example, the number of sheets in which color points were produced was reduced. It can be considered that this is because in the development device 3*b* of the example, the disk 55 was arranged between the shaft diameter change portion 44*e* and the end portion of the second spiral blade 44*a* on the downstream side (the large shaft diameter portion 44*c*), and thus it was possible to reduce the formation of a recess near the disk 55 and thereby reduce the stay of the developer in the recess which caused the developer to be coagulated, with the result that the occurrence of an image failure caused by the color points was reduced.

It has been confirmed from the results described above that in the development device 3*b* of the example in which the disk 55 is arranged between the shaft diameter change portion 44*e* and the end portion of the second spiral blade 44*a* on the downstream side (the large shaft diameter portion 44*c*), it is possible to reduce the stay of the developer in the recess which causes the developer to be coagulated, with the result that it is possible to effectively reduce the occurrence of an image failure caused by the color points.

What is claimed is:

1. A development device comprising:

a development container which includes:

a plurality of transport chambers which include a first transport chamber and a second transport chamber that are arranged so as to be aligned with each other;

communication portions which make the first transport chamber and the second transport chamber communicate with each other on sides of both end portions in a longitudinal direction of the first transport chamber and the second transport chamber;

a developer supply port through which a developer is supplied; and a developer discharge port which is provided at an end portion of the second transport chamber on a downstream side and through which the excess developer is discharged, and in which a two-component developer containing a carrier and a toner is stored;

a first agitation member which is formed with a first rotation shaft and a first transport blade formed on an outer circumferential surface of the first rotation shaft and which agitates and transports the developer within the first transport chamber in an axial direction of the first rotation shaft;

a second agitation member which is formed with a second rotation shaft and a second transport blade formed on an outer circumferential surface of the second rotation shaft and which agitates and transports the developer within the second transport chamber in a direction opposite to the first agitation member; and a developer carrying member which is rotatably supported by the development container and which carries the developer within the second transport chamber on a surface, wherein the second agitation member includes:

a regulation portion which is formed on the downstream side of the second transport blade in a direction in which the developer within the second transport chamber is transported and which is formed with a transport blade that transports the developer within the second transport chamber in a direction opposite to the second agitation member;

a discharge blade which is formed on the downstream side of the regulation portion in the direction in which the developer within the second transport chamber is transported and which transports the developer in the same direction as the second transport blade so as to discharge the developer from the developer discharge port; and a damming member which is formed on an upstream side of the regulation portion in the direction in which the developer within the second transport chamber is transported and which dams the developer transported by the second transport blade, the second rotation shaft includes:

a large shaft diameter portion on which the second transport blade is provided;

a small shaft diameter portion on which the regulation portion and the discharge blade are provided and which has a smaller diameter than the large shaft diameter portion; and a shaft diameter change portion which is arranged in a boundary between the large shaft diameter portion and the small shaft diameter portion and the damming member is arranged between the shaft diameter change portion and the end portion of the second transport blade on the downstream side.

2. The development device according to claim 1, wherein the shaft diameter change portion is formed in such a tapered shape that a diameter of the shaft is gradually changed along an axial direction of the second rotation shaft.

3. The development device according to claim 1, wherein the regulation portion has an outside diameter which is smaller than an outside diameter of the second transport blade but larger than an outside diameter of the discharge blade.

4. The development device according to claim 3, wherein the damming member has an outside diameter which is equal to or less than the outside diameter of the second transport blade but equal to or more than an outside diameter of the regulation portion.

5. The development device according to claim 3, wherein the second transport chamber includes:

a large inside diameter portion in which the second transport blade is arranged and which has a first inside diameter; and a small inside diameter portion in which the regulation portion is arranged and which has a second inside diameter that is smaller than the first inside diameter but larger than an inside diameter of the developer discharge port.

6. The development device according to claim 5, wherein the damming member is arranged within the large inside diameter portion.

7. The development device according to claim 5, wherein a gap between an outer circumferential portion of the regulation portion and an inner circumferential surface of the small inside diameter portion is larger than a gap between an outer circumferential portion of the second transport blade and an inner circumferential surface of the large inside diameter portion.

8. The development device according to claim 1, wherein a diameter of the small shaft diameter portion is equal to or more than three fourths of a diameter of the large shaft diameter portion.

9. The development device according to claim 1, wherein the damming member is formed in a position opposite the communication portion on the downstream side of the second transport chamber.

10. An image forming apparatus comprising:

the development device of claim 1.

* * * * *